US006106169A

United States Patent [19]

Adam et al.

[11] Patent Number: 6,106,169

[45] Date of Patent: Aug. 22, 2000

[54] PROCESSING PHOTOGRAPHIC MATERIAL

[75] Inventors: Henry H. Adam, Leighton Buzzard; Gareth B. Evans, Potten End, both of United Kingdom

[73] Assignee: Eastman Kodak Company, Rochester, N.Y.

[21] Appl. No.: 09/167,611

[22] Filed: Oct. 6, 1998

[30] Foreign Application Priority Data

Oct. 9, 1997 [GB] United Kingdom ..... 9721462

[51] Int. Cl.[7] ..... G03D 3/02

[52] U.S. Cl. ..... 396/626; 396/636

[58] Field of Search ..... 396/626, 627, 396/620, 622, 636, 624; 134/122 P, 64 P; 430/30, 398, 399

[56] References Cited

U.S. PATENT DOCUMENTS

| | | | |
|---|---|---|---|
| 4,178,089 | 12/1979 | Spence-Bate | 396/624 |
| 4,265,431 | 5/1981 | Falomo | 226/111 |
| 4,719,173 | 1/1988 | Hahm | 394/626 |
| 4,929,975 | 5/1990 | Shidara | 396/622 |
| 5,365,300 | 11/1994 | Wernicke et al. | 396/626 |
| 5,573,896 | 11/1996 | Carli et al. | 396/626 |
| 5,923,916 | 7/1999 | Piccinini, Jr. et al. | 396/626 |

OTHER PUBLICATIONS

Patent Abstracts of Japan, vol. 14, No. 274 (P–1061), Jun. 13, 1990 & JP 02 079841 A (Konica Corp.), Mar. 20, 1990.

Patent Abstracts of Japan, vol. 12, No. 396 (P–774), Oct. 21, 1988 & JP 63 138349 A (Konica Corp.), Jun. 10, 1988.

*Primary Examiner*—D. Rutledge

*Attorney, Agent, or Firm*—Frank Pincelli

[57] ABSTRACT

Method and apparatus are disclosed for washing exposed photographic material in less time and with a reduced replenishment rate compared with conventional processing. Multi-stage counter-current washing is employed, in which the time that the material spends in each stage is such that equilibrium of chemical concentration between solution contained in the material and solution contained in the stages (a) is reached in the final stage, but (b) is reached in fewer than all the stages, and wherein the material resides in at least one stage for a time that is different from that in at least one other of the stages. Preferably the longest time is spent in the final stage. The time distribution throughout the stages can be optimized to produce a final tank concentration comparable to that obtained with conventional processing.

8 Claims, 4 Drawing Sheets

PROCESSING PHOTOGRAPHIC MATERIAL

FIELD OF THE INVENTION

This invention relates to the processing, and particularly but not exclusively the washing or stabilizing, of photographic material, usually already exposed, in which the material passes through a plurality of stages, preferably in a counter-current mode.

BACKGROUND OF THE INVENTION

Photographic material as referred to herein is understood to be generally planar, may comprise film or paper, may produce a black-and-white or color image, and may be in a continuous web form or may comprise discrete sheets.

Silver halide photographic materials are well-known, and are processed to generate a silver or dye image via a development stage followed by a series of baths to stabilize and provide permanence to the image. Such baths convert and remove unwanted materials from the coated photographic layers which would either interfere with the quality of the final image or cause degradation of the image with time. In typical color systems the development stage is followed by a bleach stage to oxidize the developed silver to a form which can be dissolved by a fixing agent in the same or a separate bath. Such silver removal stages are then followed by a washing stage using water, or other wash solution, or a stabilization stage using a stabilizer solution. For convenience, this last-mentioned stage will hereinafter be referred to generically as "washing." Such stages remove residual chemicals and may also include conversion reactions between stabilizer solution components and materials within the coated layers. These stages are required to provide the required degree of permanence to the final image.

In many cases, particularly in small-scale "minilab" or "microlab" equipment, the wash stage is performed in a multi-tank arrangement. Usually the replenishment of this stage, which keeps the concentration of substances removed from the photographic material at a constant and sufficiently low level, is carried out by adding fresh wash solution to the final tank of the sequence and arranging over-flow from the final tank to flow into the previous tank and so on, the overflow from the first tank of this stage being then discarded as effluent. This is referred to as a "counter-current" mode. This arrangement allows significantly lower amounts of solution to be used compared with one or two tanks especially when these are replenished separately.

In all of these arrangements, processing is carried out with the photographic material immersed in a tank of solution, even though many, though not all, photographic materials are sensitized with an emulsion only on one side thereof.

In a modem minilab a typical wash replenishment system might use around 200 $cm^3$ of replenisher per $m^2$ of sensitized material processed in a three or four-tank counter-current arrangement. The time the processed material spends in each tank is typically 20 to 25 seconds during which time an equilibrium is established between the concentration of substances in the coated material and the seasoned (steady-state) concentrations in the wash solution. The total time for this stage typically varies from 60 to over 100 seconds.

U.S. Pat. No. 5,365,300 discloses a process for the treatment of photographic material with a bath containing at least one processing material, in which, after the treatment bath, the photographic material is guided upwards through an ideally preferably vertical compartment which closely surrounds the material which is washed from above by water flowing under gravity in counter-current to the material. The wash water is arranged to carry chemicals off the material into the bath for recycling.

It is desirable to process photographic material more rapidly, and in particular to reduce overall wash times by several factors, for example to about 20 seconds as compared to 100 seconds, whilst reducing overall replenishment rates. Reduction of the path-length of the wash section of the process, for example, will shorten the time taken, for a given transportation speed of the material being processed. This latter parameter is usually constrained by the demands of the previous tanks. Unfortunately, simply reducing the number of counter-current tanks involved, while achieving the goal of shorter path-length, would require a significantly increased replenishment rate to achieve the same seasoned concentration (steady-state concentration) in the final tank from which the sensitized material emerges before being introduced to the drying stage.

It is also desirable to minimize the effluent from the processing. This is advantageous not only for the protection of the environment, but also to the operator, especially of mini- and micro-labs, in terms of having less solution for disposal.

SUMMARY OF THE INVENTION

It has been found by mathematical modeling that reduction of the time in each tank may be compensated by optimizing the number of tanks, without requiring the achievement of an equilibrium state between the sensitized material and the seasoned (steady-state) condition of every tank in the sequence. It is important, however, to achieve this equilibrium in the final tank.

In accordance with one aspect of the present invention, there is provided a method of processing photographic material, wherein the material is passed successively through a plurality of stages containing solution for processing the material, wherein the time spent by the material in each of the stages is such that equilibrium of chemical concentration between solution contained in the material and solution contained in the stages (a) is substantially reached in the final stage, but (b) is substantially reached in fewer than all the stages, and wherein the material resides in at least one of the stages for a time that is different from that in at least one other of the stages.

It will be appreciated that exchange of solution between that contained within the stage and that in the material itself is primarily by a process of diffusion, so that complete equilibrium would occur in an exponential manner only after an infinite time.

Equilibrium of concentration may be substantially reached only in the final stage in order to minimize the total processing time, and consequently, the residence time of the material therein may be longer there than in any one of the preceding stages.

Advantageously, the material passes uni-directionally through the succession of stages, with the processing solution flowing in the opposite direction. In a preferred mode of putting the invention into effect, each stage may comprise an inclined, preferably planar, surface with the photographic material moving upwardly over the solution which is arranged to flow downwards. Preferably, the surfaces of each stage follow effectively end-to-end, with guides, for example, rollers, transferring the material with virtually zero cross-over time from one stage to the next. By this means, the material is effectively constantly subject to the processing solution in and between each stage.

The angle of inclination of the surface to the horizontal is preferably between about 10° and 80°, more preferably between about 30° and 50°, and most preferably is between about 40° and 45°.

The invention is particularly applicable to a washing process, but it is envisaged that it could be applied to other processing stages, for example, the development stage.

It has thus been found that even restricting both the time and the volume of replenishment allowed for processing, especially washing, photographic materials, co-optimization of these parameters can be achieved with little or no loss of performance.

Thus it is possible to devise an apparatus with very short residence times per tank, typically less than 10 seconds, and preferably less than 5 seconds, providing sufficient tanks are used. Thus, for example, both overall short process times for the wash step, less than the conventional 100 seconds, preferably less than 50 seconds, and even less than 25 seconds, as well as reduced replenishment rates. The steady-state seasoned concentration of residual chemicals in the final tank may be as low, or lower than that achieved in a conventional counter-current system. By careful selection of the number of non-equilibrium stages and the time spent in each, it has been found that very large reductions in total wash times can be combined with significant reductions (50% or more) in replenishment rates, when compared with typical current methods. It is possible to achieve these significantly lower over-all wash times whilst maintaining efficient washing and low effluent volumes.

The ability to vary the time spent in successive processing stages, by having inclined surfaces of different lengths, for example, avoids the need for a buffer storage between different stages, or the need to vary the chemical activity between the stages, or to vary the speed of transport of the material, when in discrete sheet form.

When small quantities of processing solution are used, evaporation can present a significant problem. With the present invention, however, this can be minimized when, as in preferred embodiments, the emulsion side of the photographic material is arranged to face the surface of the stage through which it is transported. In this way, the material itself acts as a cover to reduce evaporation of the solution.

Some processing solutions have hydrophobic properties, and to encourage a capillary action between the solution and the material to be processed, a thin cover of plastics material may initially be placed over the surfaces, or at least over the first surface of a stage, with the photographic material subsequently being fed underneath.

Reference is made to related commonly owned copending applications disclosing other aspects of photographic processing, U.S. Ser. No. 09/167,110, entitled PROCESSING PHOTOGRAPHIC MATERIAL, by Anthony Earle et al [Attorney Docket 76658F-P]; U.S. Ser. No. 09/167,204, entitled PROCESSING PHOTOGRAPHIC MATERIAL, by Henry H. Adam et al [Attorney Docket 76655F-P]; and U.S. Ser. No. 09/167,201, entitled PROCESSING PHOTOGRAPHIC MATERIAL, by Henry H. Adam et al [Attorney Docket 76656F-P], all filed concurrently herewith, the entire contents of which are incorporated herein.

BRIEF DESCRIPTION OF THE DRAWINGS

Methods of processing photographic material, each in accordance with the present invention, will now be described, by way of example, with reference to the accompanying drawings, in which.

DETAILED DESCRIPTION OF THE INVENTION

Figure 1:
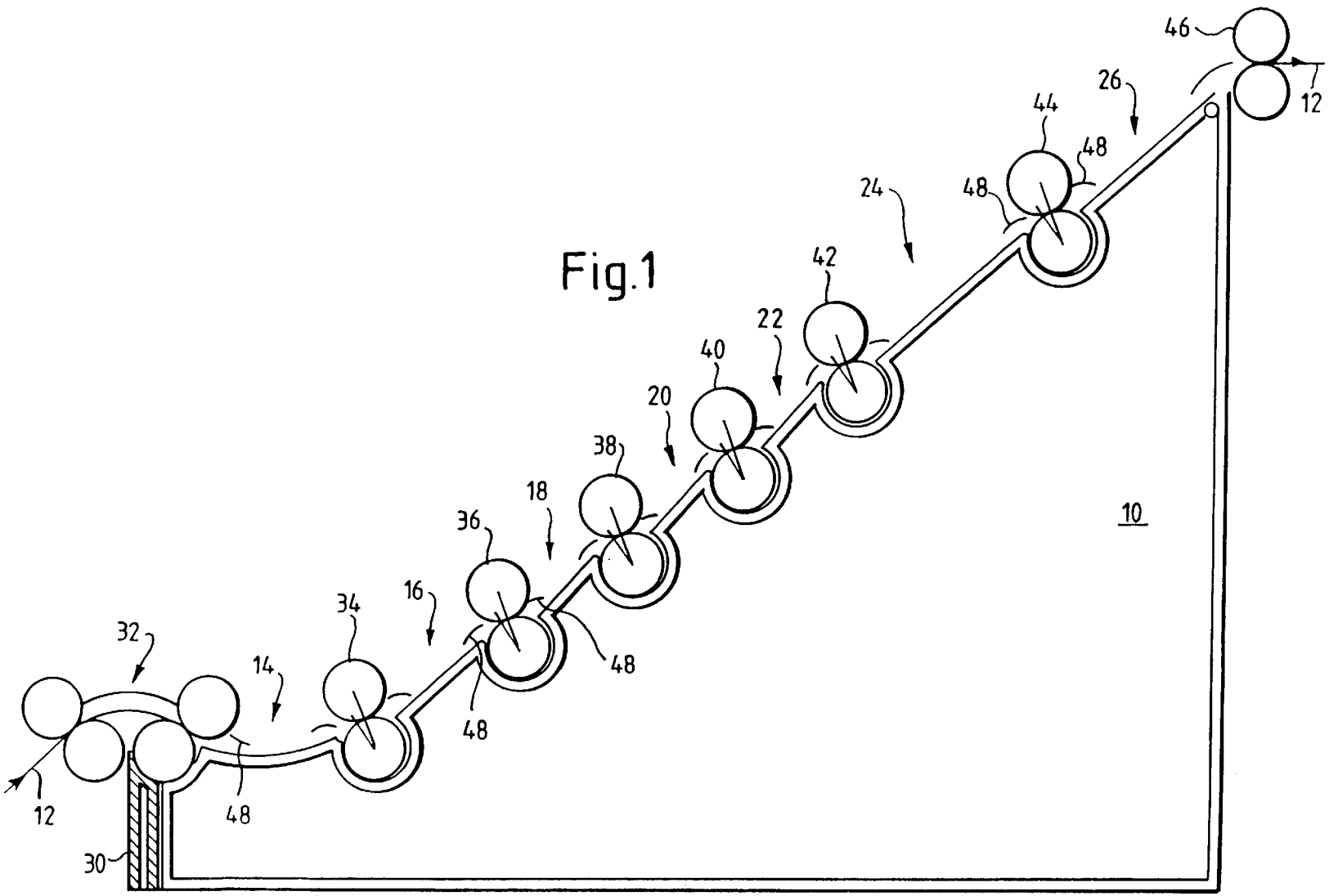
FIG. 1 is a schematic elevation of a first embodiment of an apparatus for carrying out the invention.

A mathematical model has been developed that takes into account the total wash time, the wash time in each stage, the number of stages, or processing tanks, the replenishment rate, the amount of solution carried over by the photographic material from one stage to the next, and the efficiency of each stage, and has been used to calculate the concentration of processing solution in each tank.

Under typical current operating conditions for washing photographic materials, including a replenishment rate of 18 ml/ft$^2$ for paper and 77.7 ml/ft$^2$ for film, the following results were obtained from the mathematical model:

TABLE 1

| | Total Time (s) | Stage Time (s) | No. of Tanks | Final Conc.(%) |
|---|---|---|---|---|
| Paper | 100 | 25 | 4 | 0.06 |
| Film | 60 | 20 | 3 | 0.10 |

The final concentration is given as a percentage of the concentration of the solution in the material as it enters the first tank.

Restricting the total wash time to 20s, and reducing the replenishment rate to half its former value, the model gives the following results for washing photographic paper:

TABLE 2

| Total Time (s) | Stage Time (s) | No. of Tanks | Final Conc. (%) |
|---|---|---|---|
| 20 | 5 | 4 | 1.7 |
| 20 | 4 | 5 | 1.05 |
| 20 | 3.3 | 6 | 0.76 |
| 20 | 2.86 | 7 | 0.63 |
| 20 | 2.5 | 8 | 0.6 |
| 20 | 2.2 | 9 | 0.63 |
| 20 | 2 | 0.73 | |

It is thus seen that an optimum concentration arises, and is achieved with 8 tanks, but that the final concentration value is ten times that currently available with conventional washing process, and is thus unacceptable.

However, if, in accordance with the present invention, the residence time of the material is allowed to vary from one stage to another, acceptable optimization can be achieved. The following table illustrates this for a seven tank system, with a total wash time of 20s and a replenishment rate of 9 ml/ft$^2$, with the stage times given in seconds:

TABLE 3

| Tank | Time | Time | Time | Time | Time | Time | Time | Time |
|---|---|---|---|---|---|---|---|---|
| 1 | 2.86 | 4.00 | 5.00 | 4.00 | 3.00 | 3.00 | 2.00 | 2.00 |
| 2 | 2.86 | 3.00 | 3.00 | 4.00 | 3.00 | 3.00 | 2.00 | 2.00 |
| 3 | 2.86 | 2.00 | 2.00 | 2.00 | 2.00 | 1.00 | 1.00 | 2.00 |
| 4 | 2.86 | 2.00 | 2.00 | 2.00 | 2.00 | 1.00 | 1.00 | 2.00 |
| 5 | 2.86 | 2.00 | 2.00 | 2.00 | 2.00 | 1.00 | 1.00 | 2.00 |
| 6 | 2.86 | 3.00 | 3.00 | 2.00 | 4.00 | 5.00 | 5.00 | 2.00 |

TABLE 3-continued

| Tank | Time | Time | Time | Time | Time | Time | Time | Time |
|---|---|---|---|---|---|---|---|---|
| 7 | 2.86 | 4.00 | 3.00 | 4.00 | 4.00 | 6.00 | 8.00 | 8.00 |
| Conc | 0.64 | 0.31 | 0.64 | 0.35 | 0.25 | 0.10 | 0.07 | 0.07 |

As can be seen from Table 3, the concentration achieved in the final tank is very dependent on the distribution of times between the tanks. With an equal distribution for comparison, the first column under theses conditions gives an unacceptable final concentration of 0.64%. However, an acceptable final tank concentration of 0.07%, comparable to that obtained with current operating conditions of 100 seconds total wash time and 18 ml/ft$^2$, is achievable by suitable time variation, as shown in the last two columns. As can be seen in particular from the last column, the final tank is the important one, and it can be shown that substantially equilibrium has been obtained therein, even though not in any of the preceding tanks. It will be appreciated that by suitable selection of the number of tanks and distribution of residence times, it may be possible to reduce further the final concentration for a given total wash time and replenishment rate, which parameters themselves may be further optimized. The concentration in the final tank will be the concentration of residual chemicals in the coated photographic material as it passes to the subsequent drying stage, and will thus be representative of the quantity or level of unwanted chemicals remaining in the final product.

Reference will now be made to the drawings for examples of apparatus for carrying out the method of the invention.

Referring to FIG. 1, the apparatus 10 is arranged to carry out a washing of a continuous strip of exposed photographic film 12 after it has passed through developing, bleaching and fixing stages (not shown). The apparatus 10 has seven stages, comprising an initial horizontal shallow tank stage 14 followed by a sequence of stages 16,18,20,22,24 and 26 that are inclined uni-directionally, upwards as shown, at 45° to the horizontal. Water for washing the film 12 enters the apparatus 10 only through an inlet 28 in the top stage 26, and flows under gravity down through the other stages 24 to 14 and then into an overflow outlet 30. Each washing stage 14 to 26 is defined by an inclined surface and a set of rubber-covered rollers at each end thereof. The film 12 enters at the bottom of the apparatus 10 through a set of rollers 32 that drive and guide the film down into the wash solution in the first stage 14. The film 12 then passes into the nip of the next pair of rollers 34 from where it is guided with its emulsion side downwards onto the inclined surface of wash stage 16, down which the wash solution is flowing. The film is thus guided and transported up the apparatus 10 passing successively through sets of rollers 36,38,40,42 and 44 of the wash stages 18 to 26. At the upper end of the apparatus, the film is removed by a final pair of rollers 46 and guided to a drying stage (not shown).

It will be appreciated that the film 12 will be immersed in solution in the first stage 14 such that each of its sides will be washed. This is useful when the preceding stage has involved immersion, for example in a processing tank. Most photographic materials are sensitized only on one surface, however, so that immersion is not required throughout the processing. As the film 12 progresses upwards through each successive inclined stage, it is substantially only the underside that is treated. In the present arrangement, the guiding of the film 12 over the inclined surfaces by the rollers may be enhanced by adjacent guide plates 48 which are positioned and shaped to ensure that the film is urged towards the surfaces. The counter-flowing processing solution then forms a thin layer over which the film 12 is dragged, thus ensuring effective washing.

The film 12 is transported through the apparatus at a substantially constant speed. In order to achieve the required different residence times in the various stages 14 to 26, the inclined surfaces are made of appropriately different lengths. Furthermore, as can be seen, one of each set of rollers 32 to 44, at the beginning of each stage, is counter-sunk in a channel that forms a reservoir for the processing solution flowing down the inclined surfaces. The solution is picked up from the reservoirs on the roller surfaces and is transferred to the film 12 as it moves upwardly through the nips. In this way, the film 12 is substantially constantly in contact with the solution from the time it enters the apparatus through rollers 32 until it leaves the top of uppermost stage 26. In other words, the cross-over time between each stage is substantially zero.

Figure 2:
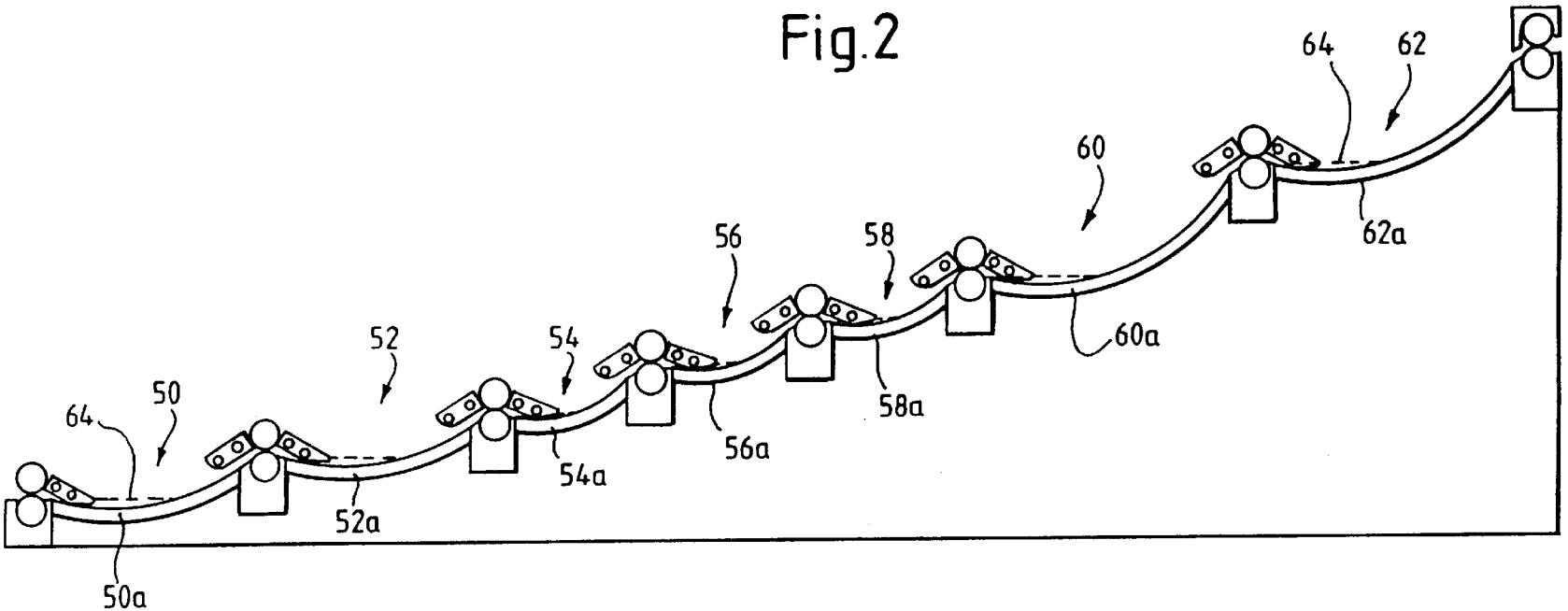
FIG. 2 is a schematic elevation of a second embodiment of an apparatus for carrying out the invention.

The apparatus 10 of FIG. 1 provides planar surfaces in each of the seven inclined stages. FIG. 2 shows a modified apparatus, in which at least the lower part, suffixed a, of each inclined stage 50,52,54,56,58,60 and 62 is curved to form a shallow trough portion in which the film 12 can be dipped in processing solution 64 before being transported out and upwards. This immersion is effective to wash the upper side of the film 12.

Figure 3:
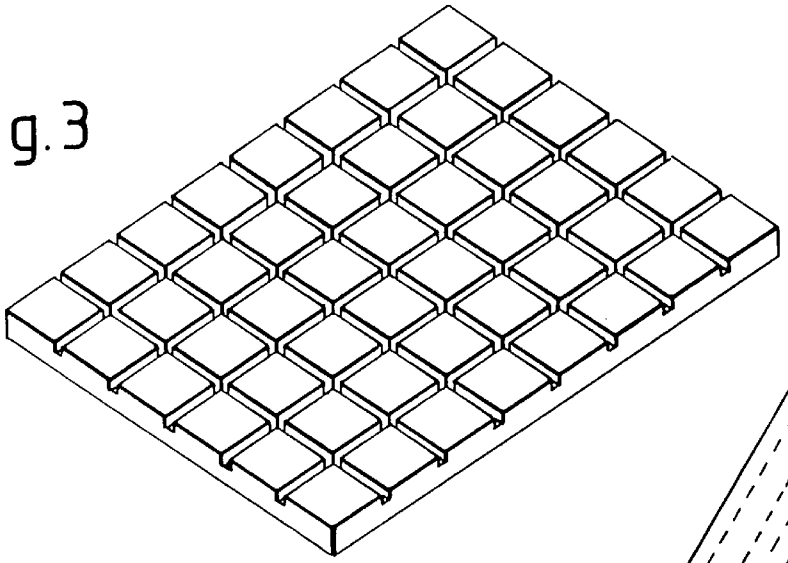
FIGS. 3–6 depict various textures of surfaces used in the apparatus of FIGS. 1 and 2.
Figure 4:
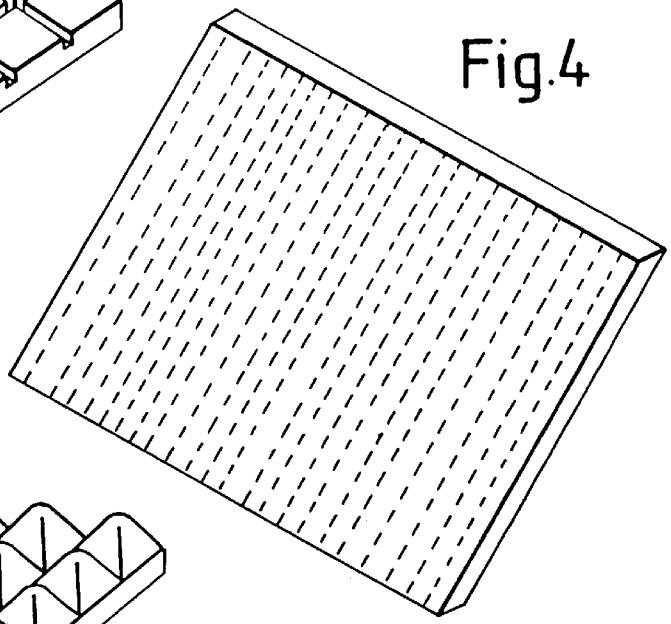
Figure 5:
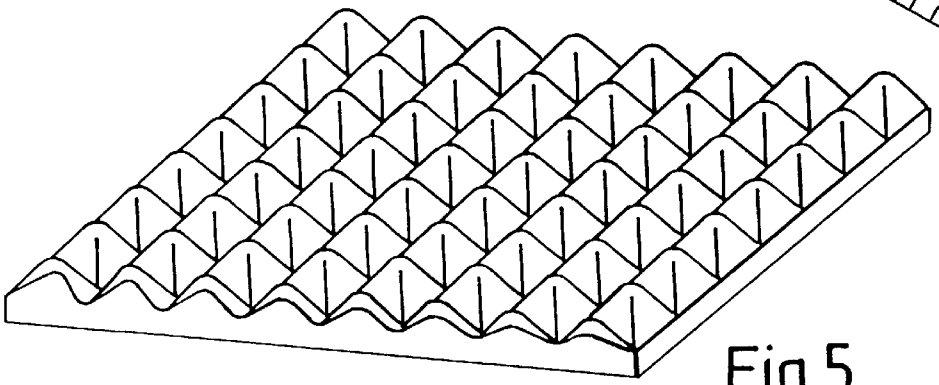
Figure 6:
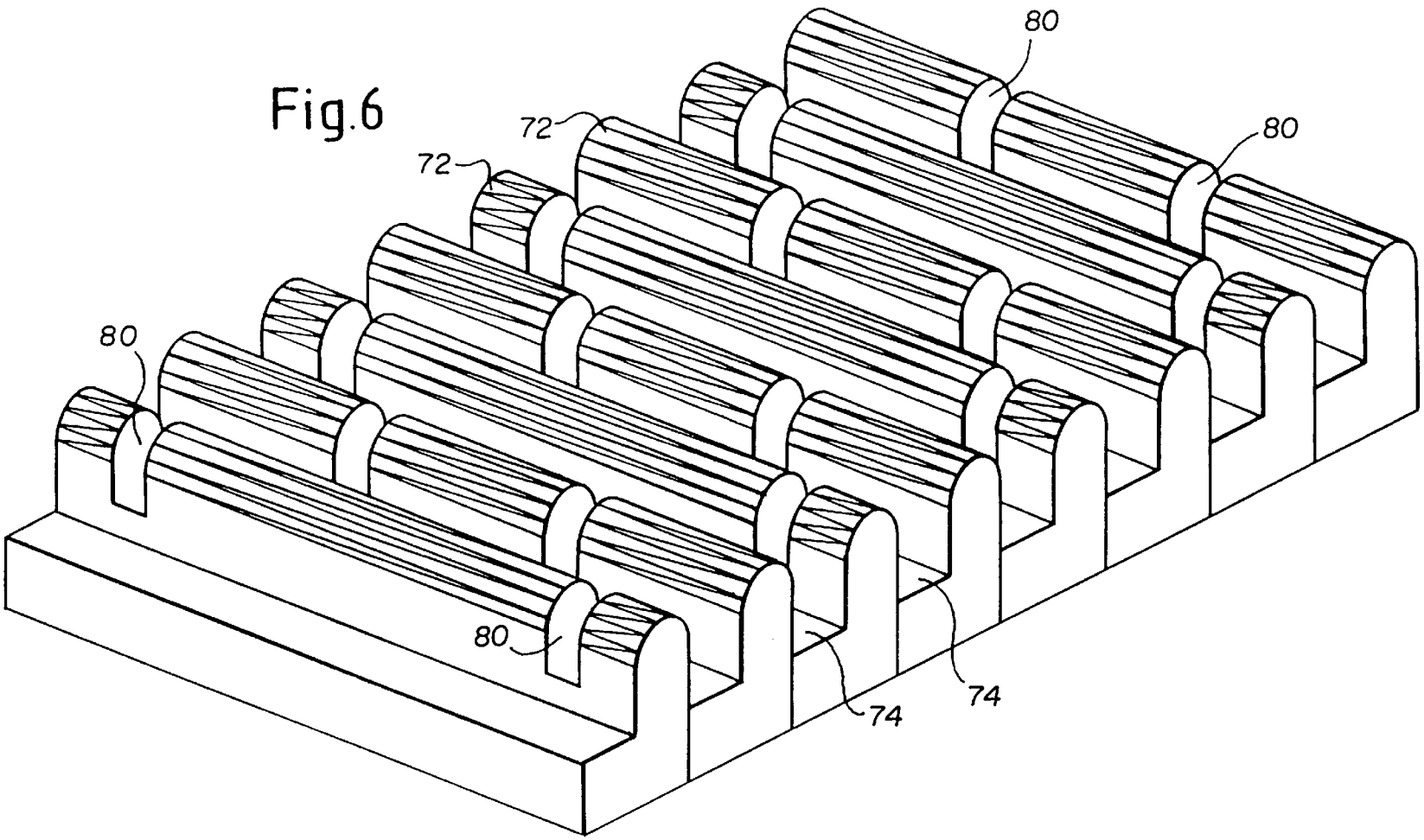

Agitation of the flowing processing solution beneath the moving strip of film can be enhanced by texturing the surfaces of the stages. FIG. 3 shows one example of this, in which part of an inclined surface is indented orthogonally. FIG. 4 shows a surface with random indentations, and in FIG. 5 the surface has a diamond configuration. Other texturing may be applied. In the enlarged view shown in FIG. 6, slots 80 are cut in transversely-extending ribs 72 of the surface. The depth of the troughs 74 between the ribs 72, the number, frequency and width of the slots 80, and their degree of stagger in successive ribs 72, can all be selected to give the required effect on the flow of the solution in the layer beneath the photographic film 12, as well as on the flow rate of replenisher counter-current to the material.

It will be appreciated that any one set of rollers may comprise more or fewer than those shown by way of example.

It is to be understood that various other changes and modifications may be made without departing from the scope of the present invention, the present invention being limited by the following claims.

Parts List

10 apparatus
12 photographic film
14 tank stage
16 stage
18 stage
20 stage
22 stage
24 stage
26 stage
28 inlet
30 overflow outlet
32 rollers
34 rollers
36 rollers
38 rollers
40 rollers

42 rollers
44 rollers
46 rollers
48 guide plates
50 stage
52 stage
54 stage
56 stage
58 stage
60 stage
62 stage
64 processing solution
72 transversely-extending ribs
74 troughs
80 slots

What is claimed is:

1. A method of washing photographic material, wherein the material is passed successively through a plurality of stages containing water or stabilizing solution for washing the material, wherein the time spent by the material in each of the stages is such that equilibrium of chemical concentration between solution contained in the material and solution contained in the stages (a) is substantially reached in the final stage, but (b) is substantially reached in fewer than all the stages, and wherein the material resides in at least one of the stages for a time that is different from that in at least one other of the stages.

2. A method according to claim 1, wherein equilibrium of concentration is substantially reached only in the final stage.

3. A method according to claim 2, wherein the residence time of the material is longer in the final stage than in any one of the preceding stages.

4. A method according to claim 3, wherein the residence time of the material in each of said preceding stages is substantially equal.

5. A method according to claim 1, wherein the residence time of the material in at least one of the stages is less than 10 seconds, and is preferably less than 5 seconds.

6. A method according to claim 1, wherein the total residence time of the material in all the stages is less than 100 seconds, preferably less than 50 seconds, and most preferably not more than 25 seconds.

7. A method according to claim 1, wherein the material passes substantially uni-directionally through the succession of stages, and wherein the processing solution is arranged to flow substantially in the opposite direction.

8. A method according to claim 1, wherein the material is transferred substantially simultaneously from one stage to the next.

* * * * *